United States Patent [19]

Ensmann

[11] 4,186,516

[45] Feb. 5, 1980

[54] POSABLE DOLL

[75] Inventor: Burt Ensmann, Flushing, N.Y.

[73] Assignee: Ideal Toy Corporation, Hollis, N.Y.

[21] Appl. No.: 886,236

[22] Filed: Mar. 13, 1978

[51] Int. Cl.[2] ..... A63H 11/10

[52] U.S. Cl. ..... 46/107; 46/138

[58] Field of Search ..... 46/161, 128, 126, 127, 46/173, 163, 136, 138, 137, 139, 140, 149, 106, 107, 121, 119; 273/85 E, 85 F; 40/411

[56] References Cited

U.S. PATENT DOCUMENTS

| | | | |
|---|---|---|---|
| 172,709 | 1/1876 | Crandall | 46/161 |
| 1,715,798 | 6/1929 | Tarkington | 46/128 |
| 2,249,670 | 7/1941 | Sidle | 46/128 |
| 2,715,793 | 8/1955 | Strauss | 46/107 |
| 3,630,520 | 12/1971 | Cooper | 46/128 X |
| 3,643,374 | 2/1972 | Gunther et al. | 46/139 |
| 4,040,206 | 8/1977 | Kimura | 46/138 |

*Primary Examiner*—Russell R. Kinsey
*Assistant Examiner*—Mickey Yu
*Attorney, Agent, or Firm*—Richard M. Rabkin

[57] ABSTRACT

A toy doll adapted to simulate skating movements of an ice skater which includes a torso, and a pair of legs pivotally connected to the torso so that one of the legs is free to rotate with substantially unrestrained movement, while the other leg is mounted on the torso for frictionally restrained rotation so that it can be held in selected positions. The doll is positioned on a stand and movement of the stand will cause the torso to pivot about the first leg, to a plurality of different positions.

8 Claims, 8 Drawing Figures

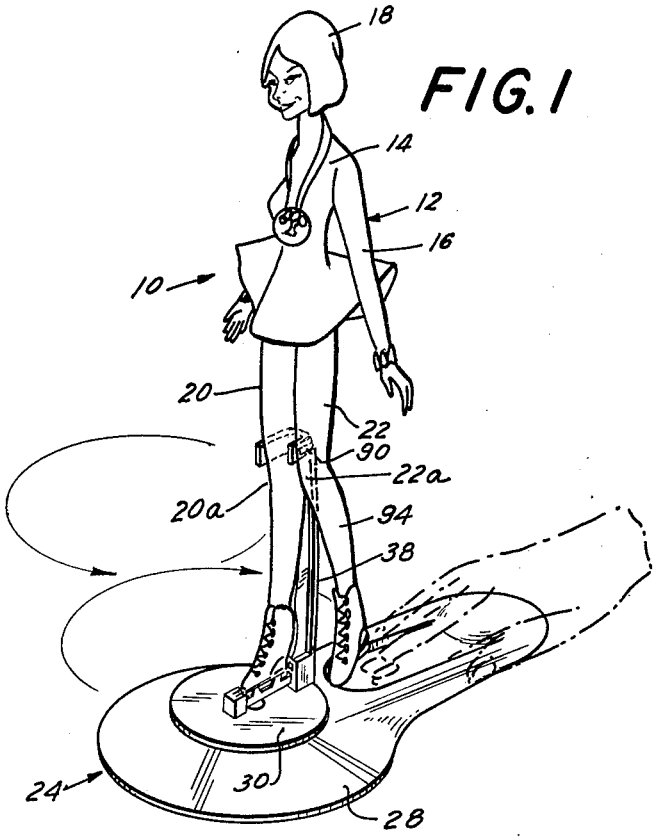
FIG. 1
FIG. 2
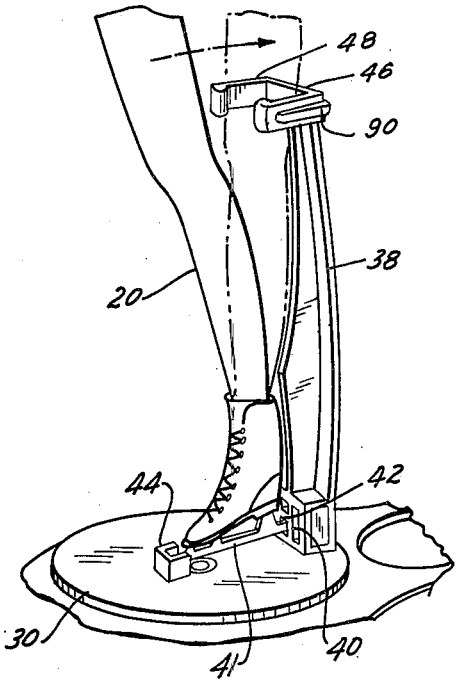
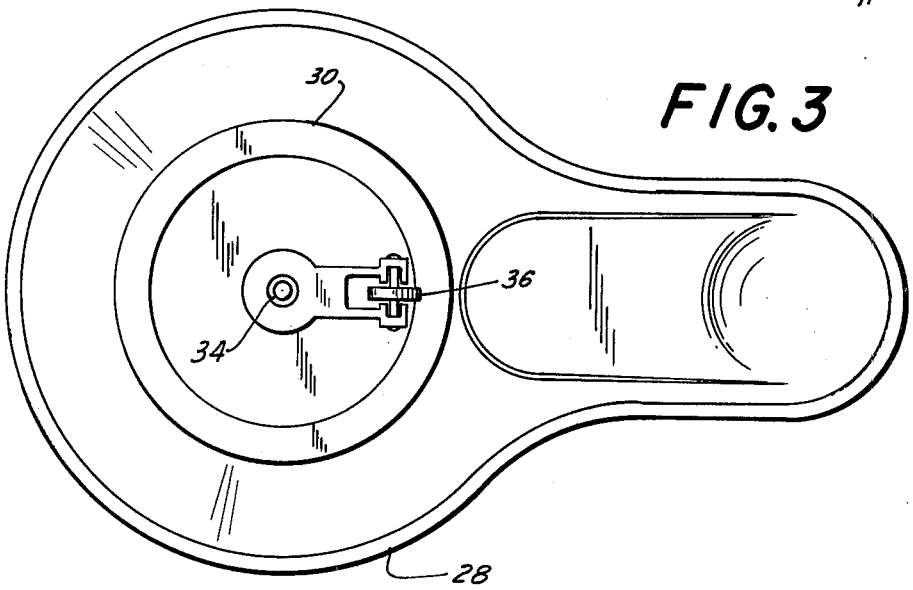
FIG. 3

POSABLE DOLL

The present invention relates to toy dolls, and in particular to an articulated toy doll whose body can move to a variety of different positions in response to movement of the doll.

Posable toy dolls have been previously proposed which enable a child to position the doll's limbs in a variety of different configurations. Such dolls usually have conventionally constructed arms and legs which include friction clutch members or other conventional constructions therein that enable the limbs to be moved at the joints into a plurality of different positions. A number of such dolls are also provided with support stands which engage one or both of the doll's legs, to hold the doll in an upright position in the selected pose. Such stands have also included turntable portions which enable the doll to rotate on the stand. However, with all of these dolls, the pose selected for the limbs of the doll remains constant throughout play until physically changed by the child. Thus, the doll cannot move from one position to another to change its pose automatically during movement of the support stand without having its limbs physically moved from one position to the other by the child.

It is an object of the present invention to provide a posable toy doll whose pose will change in response to movement of the doll.

A further object of the present invention is to provide a posable toy doll which will simulate a plurality of different types of movements, in particular ice skating movements.

A further object of the present invention is to provide a posable toy doll, whose pose can be varied, that is relatively simple and inexpensive in construction.

Yet another object of the present invention is to provide a posable toy doll which can simulate ice skating movements, and which is durable in construction.

In accordance with an aspect of the present invention a toy doll is provided which is adapted to simulate certain ice skating movements. The doll includes a torso and a pair of arms and legs. The arms and legs are themselves conventionally constructed to be posable, i.e. they can be bent into a variety of different positions at their joints in order to vary the pose of the doll. However, the mounting of the legs of the doll on the torso is unique in the doll of the present invention in that it permits the doll to change poses during movement of the doll. Specifically, one of the legs of the doll is freely pivotally mounted on the torso for relatively free unrestrained pivotal movement between at least two predetermined positions at which the torso is horizontal and extends perpendicular to the leg. The other leg of the doll is pivotally mounted on the torso in relatively tight friction engagement therewith to permit movement of the second leg to any of a plurality of positions with respect to the torso, but with this other leg being maintained in its relative position with respect to the torso by the tight frictional engagement therebetween.

The doll is mounted on a support stand which includes a support frame holding the loosely pivoted leg in the stand in a relatively fixed position. By this arrangement, movement of the stand will cause the torso and the second leg frictionally held thereon to pivot with respect to the first leg to one of the two predetermined positions. By this arrangement, depending upon the position in which the arms and legs of the doll are posed, the doll will move from an essentially vertical position to a forward leaning position to simulate a "camel" movement in ice skating or to a rearward position to simulate a lay back spin. In addition, the support stand includes means which will frictionally engage the other leg of the doll, to hold the doll against pivotal movement on the first leg, in certain positions, in order to enable the doll to simulate other skating movements, such as for example a vertical or straight up spin which do not require movement of the doll's torso.

The above, and other objects, features and advantages of this invention will be apparent from the following detailed description of an illustrative embodiment thereof which is to be read in connection with the accompanying drawings, wherein:

FIG. 1 is a perspective view of a toy doll constructed in accordance with the present invention;

FIG. 2 is a partial perspective view showing one leg of the doll as it is mounted in the support stand for the doll;

FIG. 3 is a bottom view of the doll support stand;

Figure 4A:
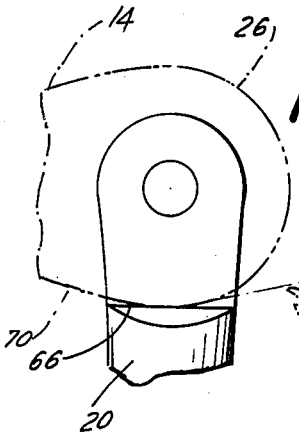
FIG. 4A is a side sectional view, taken along **4*a*—4*a* of FIG. 4**, with the torso shown in dotted lines, to illustrate one of the positions of the torso with respect to the freely pivoted leg of the doll.

Referring now to the drawings in detail, initially to FIG. 1, a toy doll 10, constructed in accordance with the present invention, includes a doll body 12 having a torso 14, arms 16, head 18 and legs 20, 22. The doll is supported through leg 20 on a support stand 24 which is adapted to be moved on a play surface in order to rotate the doll on the stand and to cause the doll to change its relative position or pose thereon.

The head, torso and arms of the doll 10 are of conventional construction with arms 16 being pivotally mounted to the shoulder of the torso in any convenient manner and being posable (i.e. bendable) at its elbows and wrists so that the arms can be placed in a variety of different positions selected by the user. The construction of such posable arms is know per se and need not be described in detail herein.

The doll's legs 20 and 22 are also of generally conventional construction, except for the mounting thereof as described hereinafter, and are also of a posable construction. That is, the legs are bendable at the knees **20*a*, 22*a*, in the conventional manner by the use of a friction clutch arrangement 26, illustrated schematically in FIG. 6**, in the known manner. Thus the calf portion of the legs can be moved to a variety of angular positions with respect to the thigh portions of the leg, in order to change the doll's pose. In addition, the legs are somewhat flexible in the lateral direction and can be slightly bent laterally of the torso at the knee and ankle joints.

Figure 6:
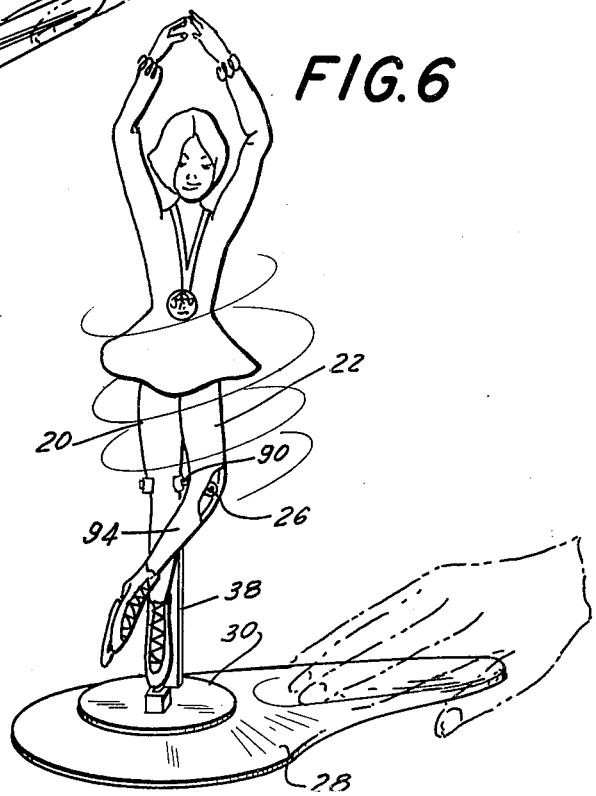
FIG. 6 is a perspective view showing the movement of the doll in its restrained position.
Figure 7:
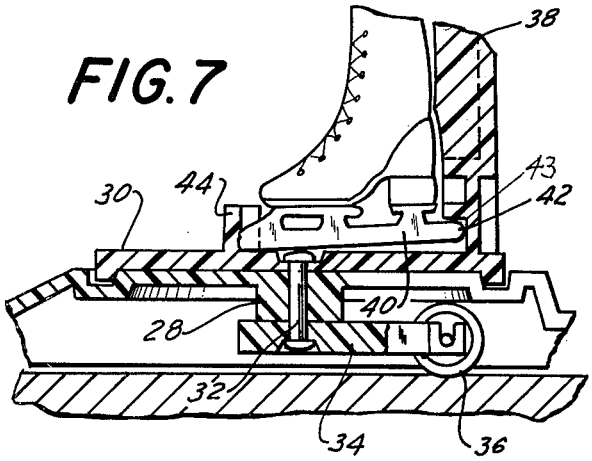
FIG. 7 is an enlarged side sectional view of the stand showing the locking of the doll's foot in the stand and the turntable arrangement used therein.

The support stand 24 used in the doll of the present invention is formed as a molded plastic shell 28 on which a turntable 30 is rotatably mounted. The turntable, as illustrated in FIG. 7, is rigidly connected to a pin 32 which extends through shell 28 to the lower portion of the shell where it is rigidly connected to a drive arm 34. The latter has a roller 36 rotatably mounted thereon in any convenient manner. By this construction, movement of the support platform 28 by the user, as illustrated in dotted lines in FIGS. 1 and 6, will cause the turntable 30 to rotate on stand shell 28. In FIG. 1, shell 28 is shown being moved in a "figure 8" pattern which will cause the turntable 30 to rotate slightly during the movement of the shell, so that the doll simulates a "figure 8" ice skating movement. Likewise, in FIGS. 5 and 6, the shell 28 is moved in a rapid rotary motion, so that the turntable 30 rotates rapidly to cause the doll to rotate rapidly to perform different types of spins, as described hereinafter.

Leg 20 is supported on turntable 30 by a support arm 38 which is either integrally formed with turntable 30 or removably mounted thereon in any convenient manner. Support arm 38 has a plurality of apertures or recesses 43 formed in its lower end which are adapted to receive the rear end 42 of simulated blade 40 on the ice skates of the doll. Likewise a support block 44 is provided on the turntable which receives the forward end of blade 40. In addition, the upper end 46 of the support arm 38 includes a generally U-shaped resilient bracket 48 adapted to receive the thigh portion of leg 20. By placing the skate blade in the support block 44 and recess 43 and the thigh of leg 20 in bracket 48, leg 20 will be held in a relatively fixed position on turntable 30 and will move with the turntable in its rotary movements.

As mentioned above, leg 20 is mounted on torso 14 for relatively free pivotal movement, at least between two limited positions, so that the torso of the doll can freely pivot with respect to leg 20 and cause the doll's posed position to be varied in response to movement of support stand 28.

Figure 4:
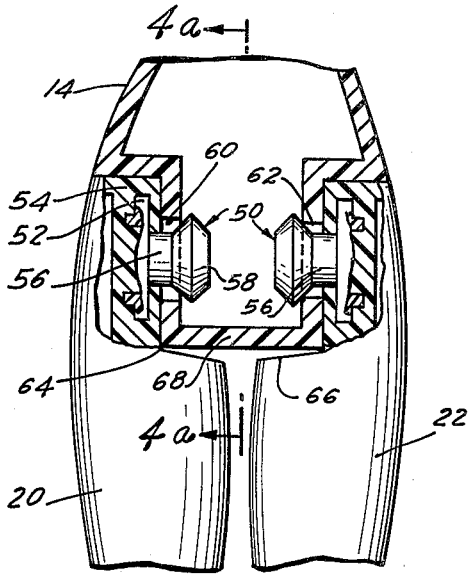
FIG. 4 is a partial front elevational view, with parts broken away, of the leg and torso connection used in the doll of the present invention.

The torso mounting arrangement for leg 20, as well as for leg 22, is illustrated in detail in FIG. 4. As seen therein, each of legs 20, 22 has an identical mushroom type stud 50 mounted therein. In particular, stud 50 includes a disc portion 52 embedded within the plastic material 54 of the upper end portion of the thigh of the doll's leg. A stem portion 56 extends outwardly from disc 52 to a mushroom head 58 of the stud. The studs 50 in each leg are of identical construction and rigidly mounted and non-rotatable in the leg by the molding of disc 52 into the material forming leg. The heads of the studs are respectively received in apertures 60, 62 formed in the torso of the doll.

Aperture 62, associated with the stud 50 of the leg 22, has a diameter which is substantially complementary to the diameter of the neck portion 56 of stud 50, so that the stud and the periphery of opening 62 are in tight frictional contact. Thus, leg 22 can pivot with respect to the torso, but it remains in its pivoted position because of the frictional contact between its stud 50 and the walls of aperture 62. On the other hand aperture 60, associated with leg 20, is substantially larger in diameter than torso aperture 62, and has a larger diameter than the neck 56 of its associated stud. Thus leg 20 is pivotally mounted on torso 14, but its pivotal movement is relatively free and unrestrained. If desired, a conventional white grease used with toy dolls can also be placed in aperture 60 to enhance the free pivotal movement of leg 20.

Pivotal movement between leg 20 and torso 14 is limited to two extreme positions of the torso because of the configuration of leg 20 which defines a stop arrangement for the torso. Specifically, the upper end of leg 20 (as well as the upper end of the leg 22) has a recess step 64 formed therein, adjacent the pivotal connection to the torso. This recess defines an upwardly facing stop surface 66 (see FIG. 4A) which is slightly curved and generally complementary to the curvature of the torso in the area 68 thereof, which would be juxtaposed to the surface 66 when the doll is in its vertical position. However, when the torso 14 is pivoted to either a forwardly bending horizontal position or a rearwardly bending horizontal position, the adjacent surface of the torso will engage the stop surface 66 and prevent further rotation thereof with respect to leg 20. Thus, in the forward bending position illustrated in FIG. 4A surface portion 70 of the torso adjacent the lower stomach area of the doll would engage the front edge of stop surface 66 and restrict further pivotal movement of the doll in a counter clockwise direction of FIG. 4A. On the other hand, rearward bending movement of the doll with respect to leg 20 would be restrained when the lower back portion 72 of the doll engages the rear portion of the surface 66 to restrain further clockwise rotation of the torso with respect to the leg 20 as viewed in FIG. 4A. It is noted that the backward bending position of the doll is not shown in FIG. 4A, but the configuration thereof would be understood by those skilled in the art.

Figure 5:
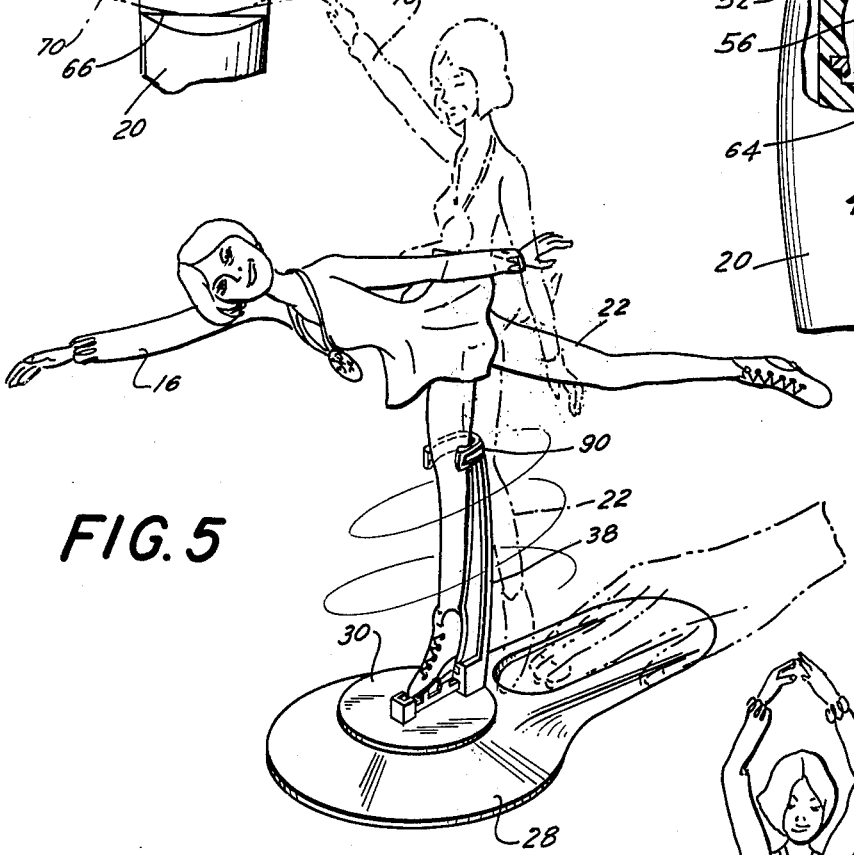
FIG. 5 is a perspective view showing the change of pose of the doll in response to movement of the support stand.

With this arrangement of the mounting for leg 20 on torso 14, when leg 20 is held in the support arm 38 of the support stand, the doll's torso can pivot into the forward bending or rearward bending position of the doll. In use, to simulate a "camel" skating move, as illustrated in FIG. 5, the doll is mounted on the support stand, as described above, and its left leg 22 is positioned slightly rearwardly of the support stand arm 38, with the torso in the vertical position. In addition, arms 16 may be posed, as shown in dotted lines, at the commencement of the play action. Rotary movement of the support shell 28 will cause arm 34 to rotate within the shell, thus causing in turn the turntable 30 to rotate. This rotation of the turntable will create a centrifugal force which will cause the doll to pivot upon the leg 20 to the forward leaning position. In this regard, it is noted that preferably the doll is designed such that the torso is slightly heavier than leg 22, so that the center of gravity of the doll is above and slightly forward of the pivot connection of leg 20 to the doll. Thus the doll will pivot in the forward direction when the doll's torso is in the vertical or slightly forward of the vertical position. (For example the legs 20, 22 may each weight 47 grams and the torso 57 grams). Continued spinning of shell 28 causes turntable 32 to spin and the doll will move forward into the forward leaning or "camel" position in a relatively smooth manner until further pivotal thereof is stopped by the engagement of the torso with the stop surface 66 of leg 20. Thus the child by properly moving shell 28 can cause the position of the doll to change and simulate the ice skating "camel" movement.

If a lay back spin is desired, leg 22 is positioned rearwardly of the support stand arm 38, as described above, and the torso is pivoted back with respect to leg 22, so that it is slightly behind the vertical and slightly rearwardly of the pivot between the torso and the leg 22. In this position the center of gravity is also located rearwardly of the pivot between the torso and the leg 22 and rotary movement will cause the doll to pivot rearwardly, until the back portion of the doll engages the stop surface 66 of the leg 20, thereby simulating a lay back spin ice skating type movement.

In order to selectively prevent pivotal movement of the torso with respect to the leg 20, so that the child can perform other types of simulated skating movements with the doll, support stand arm 38 is provided with an integral block or engagement member 90 along the leg of clip 48 adjacent leg 22. Friction block 90 is dimensioned such that when leg 22 is positioned adjacent support arm 38, block 90 will engage the inner surface 92 of leg 22, as illustrated in FIGS. 1 and 6. The frictional engagement between this block and the leg 22, will prevent the torso from pivoting on the stud 50 associated with leg 20. This occurs because of the tight frictional connection between leg 22 and torso 14; thus restraining movement of leg 22 also restrains movement of torso 14. By this arrangement, the child can pose leg 22 adjacent leg 20, as seen in FIG. 1, with leg 22 engaged against the block 90. Leg 22 can be bent rearwardly as the knee, so that calf portion 94 thereof is slightly behind the support stand, to simulate the position of a person's leg is performing a "figure 8 " on ice skates. However, the thigh portion of the leg 22 is adjacent stand arm 38 so that the thigh of leg 22 contacts block 90, holding the doll's torso against movement. Thus when stand 28 is moved in the "figure 8 " pattern illustrated in FIG. 1, turntable 30 will rotate, but the rotation will not cause the doll's torso to pivot on leg 20.

It is noted that in order to facilitate movement of the leg 22 with respect to turntable 30, either when the leg is posed manually, or when the doll pivots from one position to another, leg 22 is preferably dimensioned to be slightly shorter than the leg 20.

Another simulated ice skating move is illustrated in FIG. 6, where again leg 22 is adjacent support stand arm 38, so that the inner surface of its thigh is frictionally engaged with block 90. Calf portion 94 of the doll's leg is bent across and forwardly of the leg 20 and the arms are positioned above the doll's head, again to simulate the position of an ice skater during a particular ice skating move, which in this case is a spin. Again the frictional engagement of block 90 with leg 22 prevents the doll's torso from pivoting in response to movement of the turntable 30 when stand shell 28 is moved rapidly in a rotary pattern.

Accordingly, it is seen that a relatively simply constructed doll is provided which is adapted to change its posed configuration when desired by the operator, to simulate a variety of different ice skating moves. The doll is relatively simply constructed and durable in use.

Although an illustrative embodiment of the present invention has been described herein with reference to the accompanying drawings, it will be appreciated that various changes and modifications may be effective therein by one skilled in the art without departing from the scope or spirit of this invention.

What is claimed is:

1. A toy doll including a torso, a first leg freely pivotally mounted on said torso for relatively free unrestrained pivotal movement between at least two predetermined positions, a second leg pivotally mounted on said torso in relatively tight frictional engagement therewith permitting movement of the second leg to any of a plurality of positions with respect to the torso, said second leg being maintained in its relative position with respect to said torso by the frictional engagement therebetween; and a support stand for said doll including means for holding said first leg on said support stand in a relatively fixed position whereby movement of said stand will cause said torso and the second leg held thereon to pivot with respect to said first leg to one of said predetermined positions.

2. A toy doll as defined in claim 1 wherein said legs each include thigh and calf portions and means for connecting said thigh and leg portions to permit posing thereof in a variety of different relative positions.

3. A toy doll as defined in claim 1 wherein said support stand includes means for frictionally engaging said second leg in at least one position thereof with respect to the torso to prevent pivotal movement of the torso and said second leg with respect to said first leg.

4. A toy doll as defined in claim 3 wherein said stand includes means thereon for facilitating transilatory movement of the stand on a support surface.

5. A toy doll as defined in claim 3 wherein said second leg is slightly shorter than said first leg to facilitate pivotal movement of said second leg with said torso away from said stand.

6. A toy doll as defined in claim 3 wherein said first leg has an upper end portion adjacent said torso and the pivotal connection therebetween; said upper end portion including means cooperating with said torso for limiting pivotal movement of the torso with respect to said first leg to movement between said two predetermined positions.

7. A toy doll as defined in claim 6 wherein said limiting means limits movement of the torso to movement between two oppositely horizontally extending positions.

8. A toy doll as defined in claim 7 wherein said upper end portion of said first leg is recessed adjacent the pivotal connection thereof to said torso and forms an upwardly facing surface adjacent the torso defining said limiting means.

* * * * *